US010787782B2

(12) United States Patent
Scuero

(10) Patent No.: US 10,787,782 B2
(45) Date of Patent: Sep. 29, 2020

(54) METHOD AND DEVICE FOR THE LAYING DOWN OF A GEOMEMBRANE

(71) Applicant: CARPI TECH B.V., LA Etten-Leur (NL)

(72) Inventor: Alberto Maria Scuero, LA Etten-Leur (NL)

(73) Assignee: CARPI TECH B.V., Etten-Leur (NL)

( * ) Notice: Subject to any disclaimer, the term of this patent is extended or adjusted under 35 U.S.C. 154(b) by 0 days.

(21) Appl. No.: 16/073,013

(22) PCT Filed: Jan. 25, 2017

(86) PCT No.: PCT/EP2017/051565
§ 371 (c)(1),
(2) Date: Jul. 26, 2018

(87) PCT Pub. No.: WO2017/129627
PCT Pub. Date: Aug. 3, 2017

(65) Prior Publication Data

US 2019/0085522 A1 Mar. 21, 2019

(30) Foreign Application Priority Data

Jan. 26, 2016 (IT) ..... UB2016A0511

(51) Int. Cl.
*E02B 3/16* (2006.01)
*E02B 7/08* (2006.01)
(Continued)

(52) U.S. Cl.
CPC ..... *E02B 3/16* (2013.01); *E02B 3/121* (2013.01); *E02B 5/02* (2013.01); *E02B 7/08* (2013.01)

(58) Field of Classification Search
CPC ... E02B 3/16; E02B 3/121; E02B 5/02; E02B 7/08
(Continued)

(56) References Cited

U.S. PATENT DOCUMENTS 4,473,982 A 10/1984 Monari
4,519,172 A 5/1985 Ristow
(Continued)

FOREIGN PATENT DOCUMENTS

EP 0459015 A1 12/1991
EP 0722016 A1 7/1996

OTHER PUBLICATIONS

International Search Report and Written Opinion of the International Searching Authority Application No. PCT/EP2017/051565 Completed: Mar. 23, 2017; dated Mar. 30, 2017 12 pages.

*Primary Examiner* — Sean D Andrish
(74) *Attorney, Agent, or Firm* — Whitmyer IP Group LLC

(57) ABSTRACT

A method and a device for laying down and sealingly anchoring a waterproofing liner of a synthetic material, on a surface of a hydraulic work, by a plurality of anchoring assemblies each including a lower and an upper metal sections configured with a raised part and side sloping walls, wherein the lower metal section bar has a set of anchoring holes at a plurality of axially spaced anchoring zones; the surface of the hydraulic work is marked with a set of reference marks at a plurality of fastening zones, corresponding to the set of anchoring holes of the lower section bar; each lower section bar is fastened to the hydraulic work by anchoring devices threaded into an anchoring hole of a respective anchoring zone of the lower section bar, and into a perforation of the hydraulic work provided at one of the set of reference marks at each fastening zone.

24 Claims, 9 Drawing Sheets

(51) Int. Cl.
*E02B 5/02* (2006.01)
*E02B 3/12* (2006.01)

(58) Field of Classification Search
USPC ..... 405/107, 109
See application file for complete search history.

(56) References Cited

U.S. PATENT DOCUMENTS

| | | | | |
|---|---|---|---|---|
| 5,720,576 | A * | 2/1998 | Scuero | E02B 7/08 405/116 |
| 6,354,762 | B1 * | 3/2002 | Muramatsu | E02B 7/005 405/107 |
| 8,468,762 | B2 * | 6/2013 | Lizarazu | E04B 9/183 52/404.2 |
| 2011/0176876 | A1 * | 7/2011 | Scuero | E02B 3/16 405/259.1 |
| 2015/0322638 | A1 * | 11/2015 | Suazo | E02B 3/12 405/118 |

* cited by examiner

METHOD AND DEVICE FOR THE LAYING DOWN OF A GEOMEMBRANE

TECHNICAL FIELD

The invention refers to a method, an assembly and a device for laying down, tensioning and anchoring a waterproofing liner on a surface of a hydraulic work. Specifically, but not exclusively, the invention can be used for the laying down and the tensioning of a liner comprising a plurality of waterproof geomembranes suitable for coating a hydraulic work as, for example, a canal, a dam, a water basin, a hydraulic conduit.

BACKGROUND

The surface to be made waterproof can comprise, for example, the slopes and/or the bottom of a canal, or of an artificial basin, or the upstream side (in contact with the water) of a dam, or the inner surface of a hydraulic tunnel.

Anchoring and tensioning systems of waterproofing geomembranes for lining a hydraulic work are already known, wherein the membranes consist of a plurality of waterproofing sheets, of elastically yieldable synthetic material, that are clamped and made adhere to a hydraulic work surface, sealingly locking them by a plurality of locking assemblies that extend in a longitudinal direction, parallel and spaced apart one another. Each locking assembly comprises a lower metal section bar that is anchored to the surface of the hydraulic work and an upper metal section bar that conforms to the lower section bar, and wherein the waterproofing sheets are locked and tensioned by fastening them between the lower section bars and the upper section bars.

EP 0 459 015 A1 shows a system for the protection of dams wherein a liner in waterproofing material, providing a barrier to vapour and water seepage, is mechanically fixed, according to parallel lines, to the surface of the dam to be protected, by means of a plurality of tensioning assemblies each comprising a lower section bar that is anchored to the upstream surface of the dam, and a differently configured upper section bar; the sealing is achieved by inserting and pressing suitable gaskets between the waterproofing sheets and opposite surfaces of the two metal section bars.

U.S. Pat. No. 4,473,982 shows a device for the laying down and tensioning of a waterproofing liner on a surface to be protected, with two differently metal profiles configured differently between which a liner is clamped and tensioned by means of the same anchor devices for the two metal profiles.

EP 0 722 016 A1 shows in its turn a hydraulic work whose surface, being in contact with the water, is protected by a waterproofing liner sealingly clamped by an anchoring system comprising metal profiles basically similar to the previous ones, but covered with a strip of waterproofing material guaranteeing the sealing, that would otherwise be hindered by the presence of the connector of the two profiles that necessarily has to pass through the waterproofing liner thus preventing its impermeability.

One of the problems of the prior art anchoring systems is that the section bars or metal profiles can be subject to stress and consequent deformations caused by external forces acting on the waterproofing geomembrane liner; in particular the upper section bar can locally deform where external stress mostly concentrates, mainly due to the remarkable stresses transmitted by the geomembrane caused by the hydrodynamic strength of water flowing at high speed, in a canal or hydraulic tunnel, or caused by waves within big basins, or by the strong action of wind suction (for example in case of hurricanes) on the exposed part of the liner, or by the actions generated by ice blocks or big ice pieces.

The deformation of the section bars can imply the risk of tears and breakups of the waterproofing liner, with consequent water losses and risk of seepage in the same hydraulic works. Furthermore, the deformation of the section bars, as regards canals or hydraulic tunnels, can create a big obstacle to the water flow, providing turbulences and hydrodynamic losses, with consequent reduction of the delivery flow of the canal or hydraulic tunnel, and possible flooding that penetrate into the ground thus hindering its stability.

A further problem of the prior art laying down and tensioning systems for waterproofing liners, derives from the fact that in order to anchor the lower section bar to the hydraulic work surface, it is required to make in depth perforations for inserting the anchor devices within the hydraulic work structure; in case, during a perforation, obstacles are met (for example a reinforcing rod within the concrete, or any other kind of obstacle) thus making the perforation itself difficult as well as the penetration of the anchor device, the time and costs for the laying down of the liner to the hydraulic work can increase even considerably if compared to the planned costs.

U.S. Pat. No. 4,519,172 finally shows a waterproofing liner for a roof, wherein a waterproofing elastic membrane is fastened between a lower section bar anchored to the roof structure by means of screws or traditional anchor devices, and an upper section bar only partially conforming to the lower section bar; this solution is not suitable for the hydraulic works whose waterproofing liner can be subject to considerable external forces, and wherein there is the problem of the possible presence of obstacles preventing the penetration of anchor devices. Moreover, the solution shown by U.S. Pat. No. 4,519,172 can be improved both as regards the solidity of the anchor system of the waterproofing liner, as well as the water sealing effectiveness in the anchoring and tensioning zones of the waterproofing liner, which is comprised between the section bars.

SUMMARY

A scope of the invention is to allow the laying down, the anchoring and tensioning of a waterproofing liner to a hydraulic work through a simple and fast method, even in case obstacles are encountered during the perforation and insertion of the anchor devices in the body of the hydraulic work structure, for example the presence of reinforcement bars for a concrete hydraulic work.

An advantage is to propose a device for the anchoring and tensioning of a waterproofing liner for a hydraulic work, being particularly strong and able to withstand the big stresses transmitted by the waterproofing liner itself, caused by external agents.

A further advantage is to guarantee an effective water sealing near the anchoring and tensioning section bars, in particular in the anchor points of the section bars to the body of the hydraulic work structure.

An advantage is to avoid the use of the coverage strip of the two section bars, thus favouring the laying down and tensioning process of the waterproofing liner, remarkably reducing the working time.

Another advantage is the reduction of risks of deformation of the section bars and the stresses of the waterproofing liner.

These scopes and advantages, and many more, are achieved by a method according to claim and/or a tensioning and locking assembly, a device and/or a waterproofing liner according to the invention.

As an example, the proposed solution can comprise the use of a locking assembly with two section bars one on top of the other, having possibly different thickness, in particular the upper section bar having a higher thickness than the lower section bar.

The lower section bar (or an additional elongated anchoring element to which the lower section bar can be connected) is anchored to the surface to be protected, by means of anchor devices that penetrate into the body of the hydraulic work body; in order to overcome the problem of the accidental presence of possible obstacles for the perforation of the hydraulic work, the lower section bar (or the additional elongated anchoring element) is configured provided with a plurality of sets of anchoring holes, each hole being suitable for the insertion of an anchor device; and wherein each set of holes comprises two or more holes, and wherein the various sets of holes are arranged on the lower section bar (or on the additional elongated anchoring element) in axially spaced apart positions, next to just as many anchoring zones on the surface of the hydraulic work. The lower section bar is anchored to the body of the hydraulic work through anchor devices in correspondence of at least one hole of each set of anchoring holes, wherein there is no obstacle to the insertion of the anchor devices.

It is specified that, in the present description, the portion of surface of the hydraulic work on which a single previously perforated section bar will be arranged, will be called anchor strip, being a portion of surface narrow and elongated in a longitudinal direction. Each anchor strip presents a plurality of anchoring zones spaced apart one another in a longitudinal direction. Each anchoring zone of the upper section bar to the surface of the hydraulic work is associated to a corresponding anchoring zone of the lower section bar (or additional elongated anchoring element); each anchoring zone of the lower section bar, or additional elongated anchoring element, is provided with a relative set of two or more anchoring holes, positioned differently. The perforation of the hydraulic work and the insertion of the anchor devices is made beside at least a hole for each set of holes for each anchoring zone.

The anchoring zones on the surface to be made waterproof can be previously provided with reference marks for the perforation, corresponding in number and positions to the sets of holes in the lower section bar or additional elongated anchoring element. Such perforation reference marks, in each anchoring zone, shall thus correspond to the position of the anchoring holes in the lower section bar (or in the additional elongated anchoring element).

The mode to indicate the anchoring zones on the hydraulic work, through the use of reference marks for making holes, can vary. For example, it is possible to lay down a pre-perforated mask (in the form of plate of flat strip) on the portion of surface (anchor strip) where the lower section bar will be arranged (or the additional elongated anchoring element), and use such mask in order to mark the anchor points through suitable reference marks (for example by spraying a paint). Such mask shall be perforated in such a way that the position of its holes correspond exactly to the one of the lower section bar holes or of an additional elongated anchoring element. In another example, it is possible that the lower section bar itself, or the additional elongated anchoring element, serves as mask.

After marking the surface of the hydraulic work by means of reference marks in correspondence of the points to be perforated of each zone, it is possible to assess the possible presence of an underneath reinforcement bar (or another obstacle for the insertion of an anchor device that would make the perforation operation complicated) in correspondence to the perforation points. In case, both before and during the perforation operation, an obstacle is found in correspondence of the reference point chosen for the perforation, such point is discarded and another one belonging to the same anchoring zone is chosen.

In fact, since each anchoring zone comprises two or more reference marks for the perforation arranged close one another, if a reference mark is discarded, another one shall be chosen, positioned relatively close within the same anchoring zone, where there is no obstacle.

The presence of obstacles for the perforation and insertion of anchoring devices can be detected before positioning the lower section bar or the additional elongated anchoring element.

Once the holes have been made along the anchor strip, the pre-perforated section bar (lower section bar or additional elongated anchoring element) is arranged on the anchoring strip in such a way that the anchoring holes of the section bar are aligned to the perforated holes just obtained on the hydraulic work, by anchoring the section bar or the additional elongated anchoring element through suitable anchor devices.

Once the various lower section bars are laid down and anchored on the various anchor strips of the surface to be made waterproof, the waterproofing liner is laid down (composed, for example, of several sheets of elastically flexible geomembrane, made of synthetic material, arranged close one another with overlapped edges, thermo-sealed or not depending on the cases), then upper section bars are put on top fastening them to the lower section bars of each tensioning assembly.

The following takes place during the clamping of the upper section bars to the lower section bars:

the mechanical locking of the waterproofing liner between the two section bars;

the water sealing by way of the compression of the liner between opposite or facing surfaces (flat and inclined) of the two section bars;

the tensioning of the geomembrane for making it perfectly adhere to the surface to be made waterproof, with no folds and/or crease that might represent an obstacle for the flowing of water in a canal or hydraulic tunnel, or points of would be breakup or tearing caused by external stresses.

In case it is intended to further improve the water sealing near the holes of the waterproofing liner where connecting members (for example anchor bolts) pass between the two section bars, it is possible to arrange a sealing gasket between the central partition of one of the section bars (for example the upper section bar) and the waterproofing liner. Such gasket can comprise a single strip extended along the whole section bar. Alternatively it is possible to arrange specific gaskets beside each connecting member between metal section bars.

It is also possible to provide that the axial distance (pitch) between two adjacent anchoring zones is at least double the distance between anchoring holes being part of the same set of holes, or greater. In other words, the anchoring holes are distributed along the section bar in such a way that, within each set of holes, the holes are grouped at a mutual relatively small distance, while anchoring holes belonging to two different sets of holes are arranged at a mutual higher distance.

As an example, the lower section bar can comprise lateral locking wings provided with holes for anchor devices on the hydraulic work, and holes for connecting members on the upper section bar arranged in a central raised part of the lower section bar.

In another example, the lower section bar can have no lateral wings, or can have lateral edges configured to be connected (welded) to an additional elongated anchoring element arranged underneath, that is positioned and locked to the surface of the hydraulic work.

In a further example, the lower section bar can comprise an upper partition and two inclined side walls, having no lateral locking wings and being provided with anchoring holes on the upper part of the section bar, wherein such anchoring holes are intended for the insertion of anchor devices into the hydraulic work body.

BRIEF DESCRIPTION OF THE DRAWINGS

The invention shall be better understood and implemented by referring to the enclosed drawings showing no limitative examples.

Figure 1:
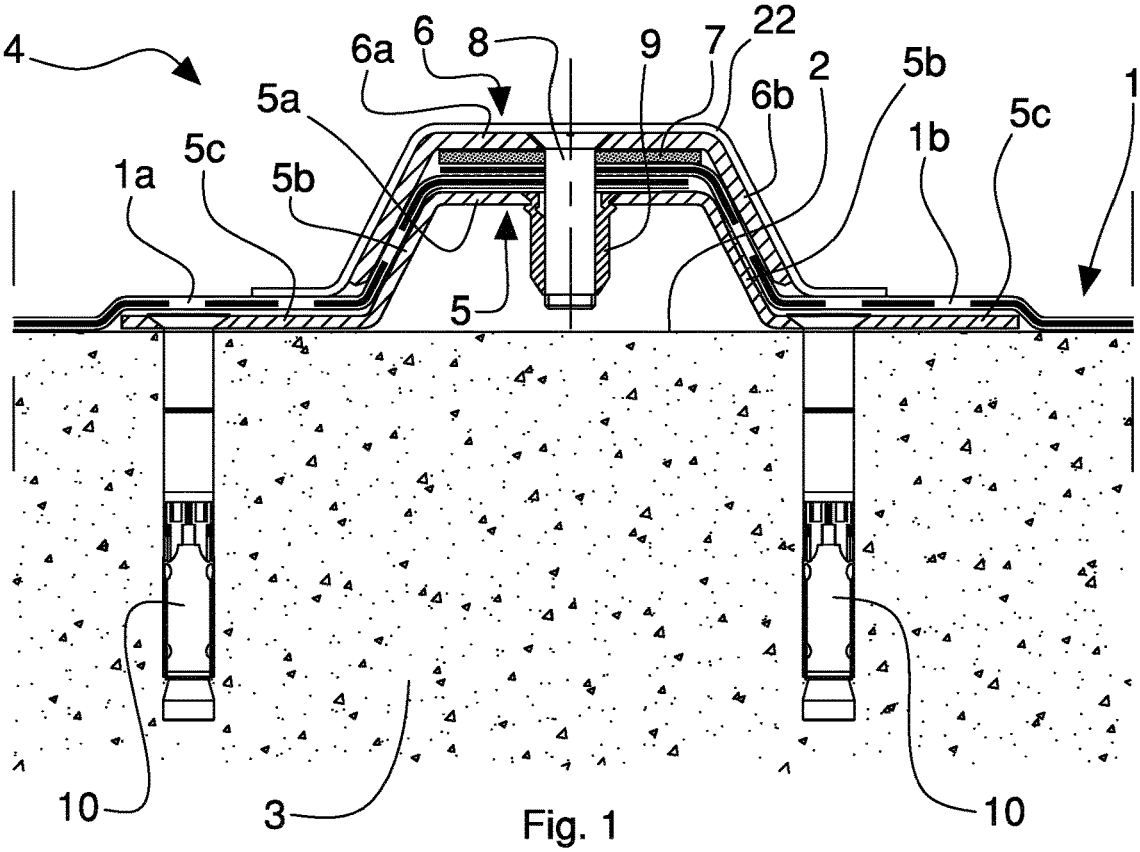
FIG. 1 is a cross-sectioned view of a first example of a locking assembly according to the present invention, for sealingly clamping and tensioning a waterproofing liner on a surface of a hydraulic work to be waterproofed, in a locking zone between section bars, wherein two sheets of the waterproofing liner have overlapping edges.
Figure 2:
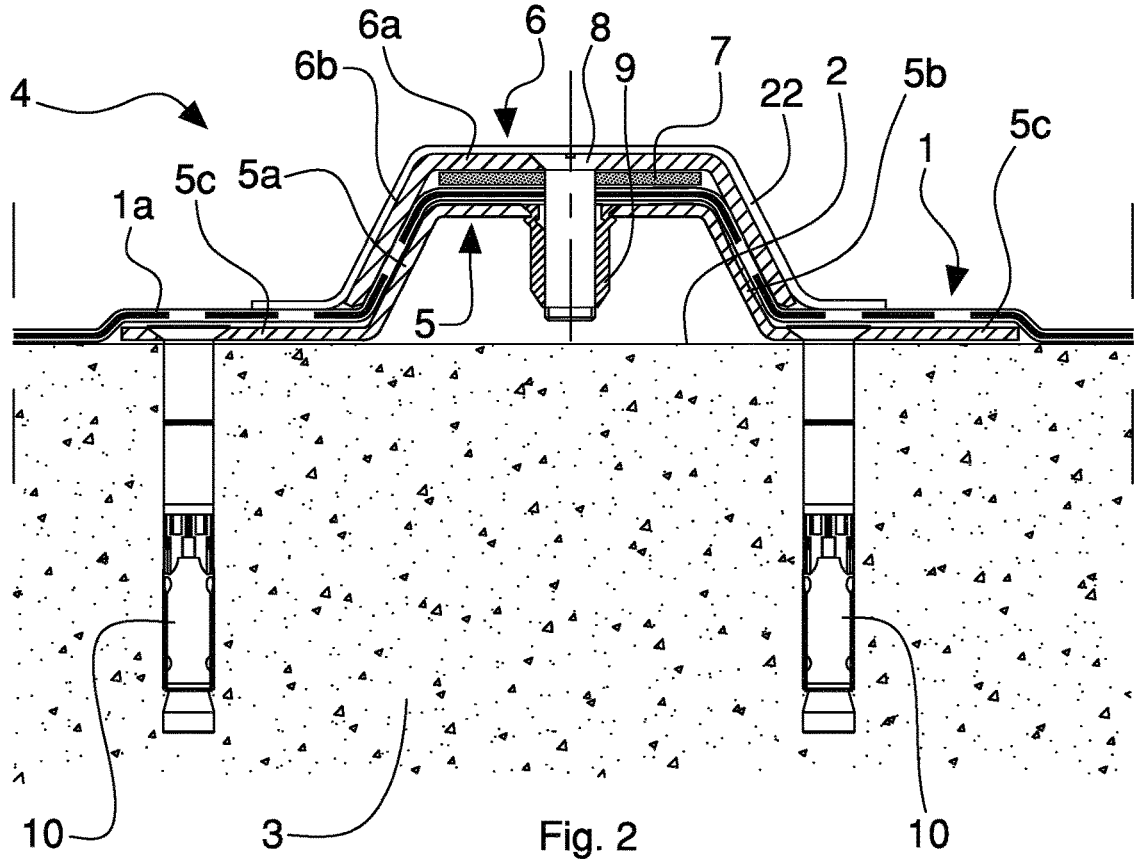
FIG. 2 is a cross-sectioned view similar to FIG. 1 wherein a single sheet of the waterproofing liner is present in the clamping zone between the section bars.
Figure 3:
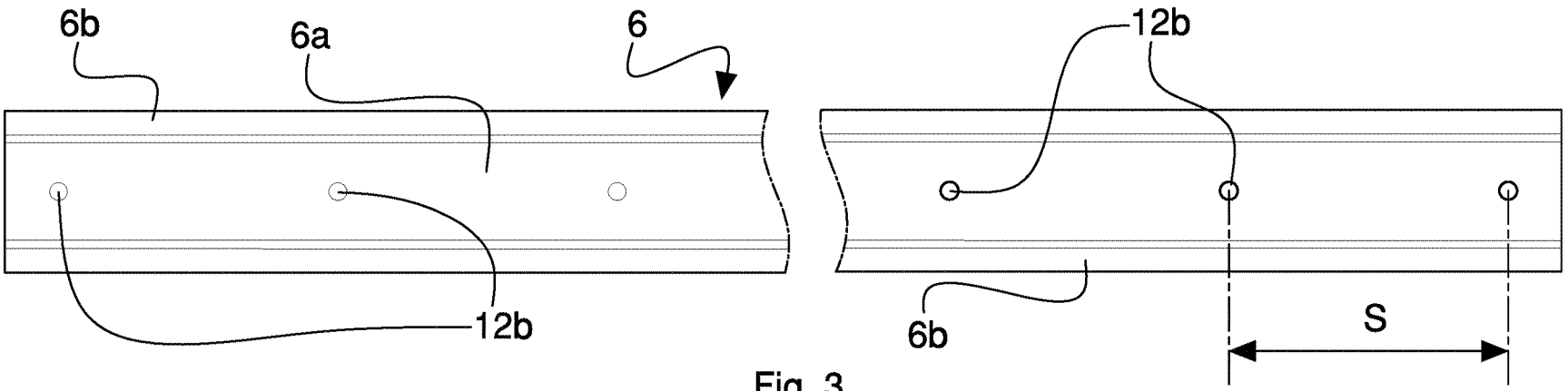
FIG. 3 is a view from above, of the upper section bar of the locking assembly of FIG. 1 or 2.
Figure 4:
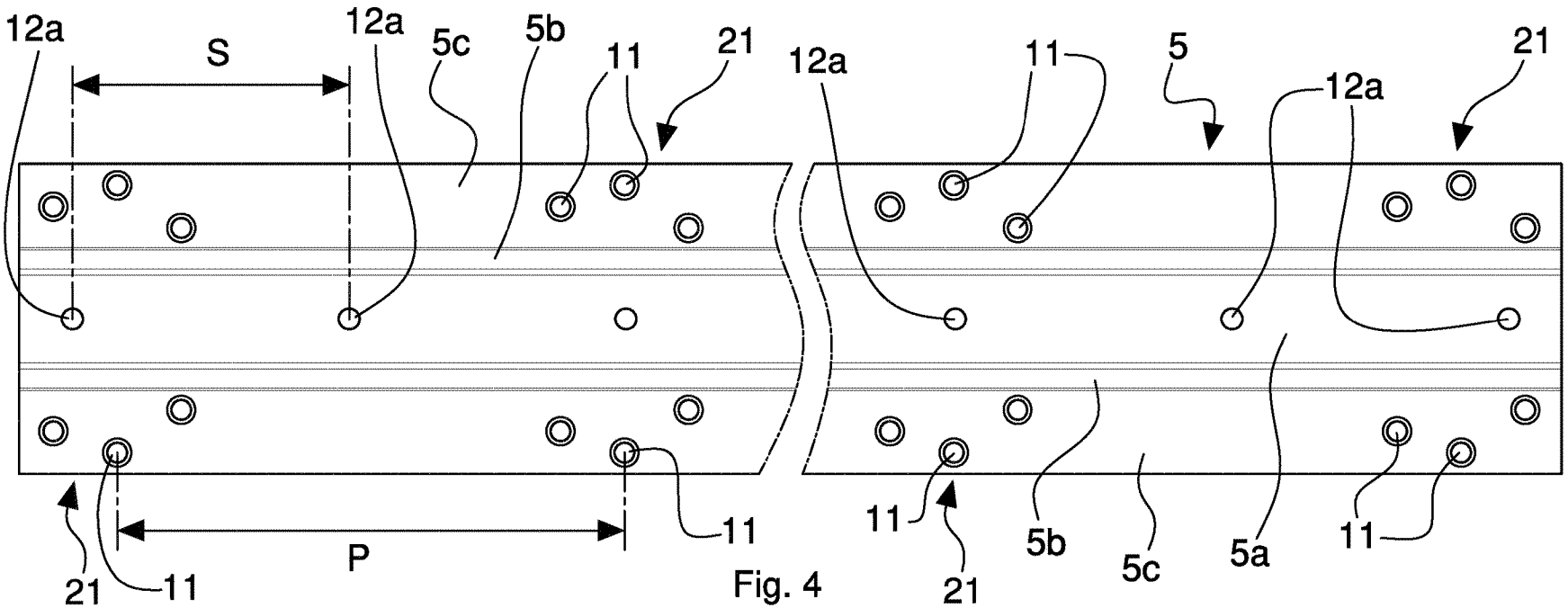
FIG. 4 is a view from above, of the lower section bar of the locking assembly of FIG. 1 or 2.
Figure 5:
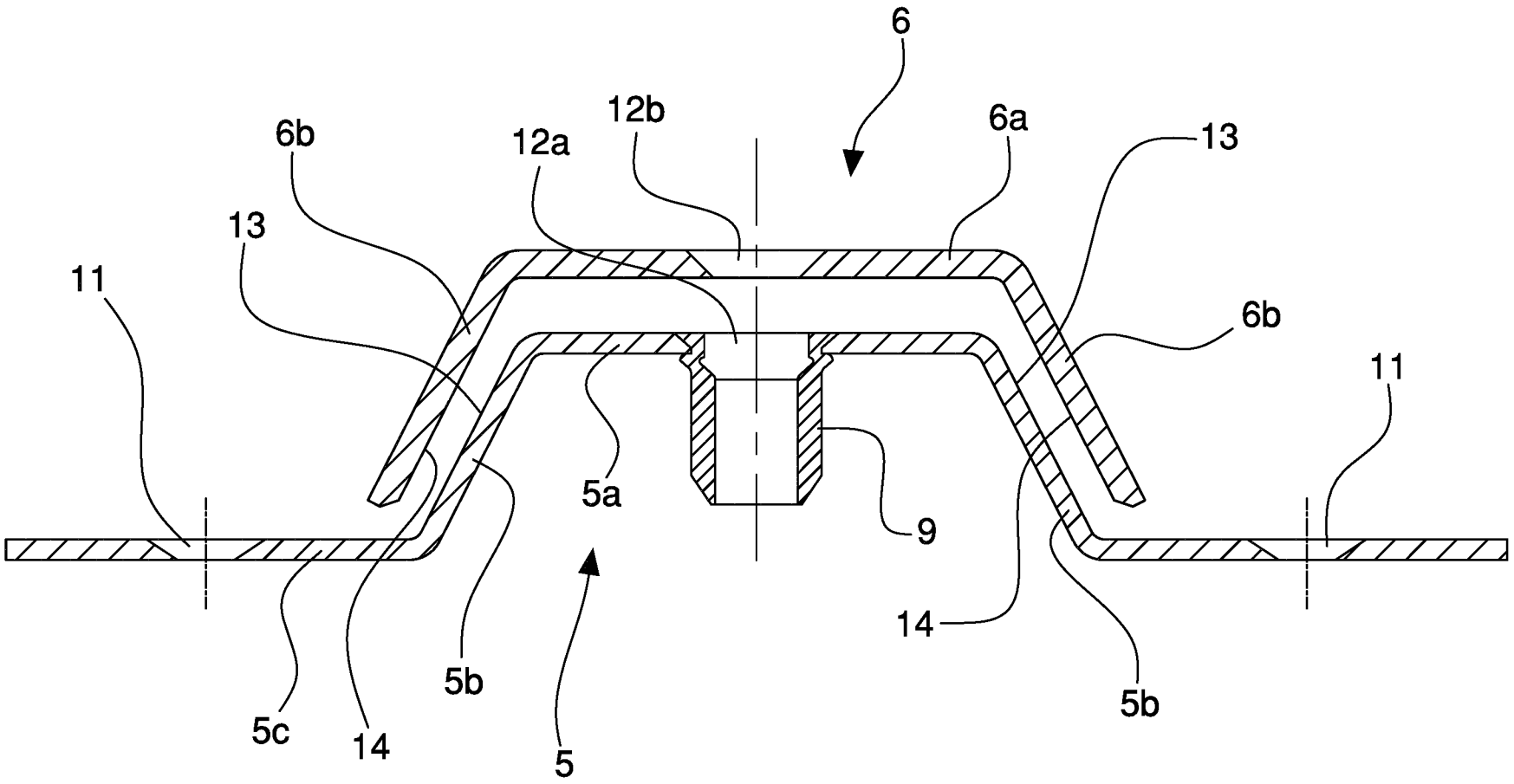
FIG. 5 is a section in enlarged scale of lower and upper section bars of the locking assembly of FIG. 1 or 2.

Figures from 12 to 15 are four views from above showing some phases of a method for laying down and tensioning a waterproofing liner on a surface of a hydraulic work.

DETAILED DESCRIPTION

With reference to the above figures, it is to be noted that similar elements, though belonging to different implementation examples, are indicated with a same reference number, for simplicity purposes.

By reference number 1 it is indicated a waterproofing liner for a big hydraulic work. The liner 1 comprises a plurality of geomembrane sheets 1*a*, 1*b* arranged one next to the other, wherein adjacent geomembrane sheets 1*a*, 1 *b* have edge portions reciprocally overlapping. A waterproofing liner, as known, comprises a plurality of membrane sheets elastically flexible, made of synthetic material, suitable for waterproofing a surface 2 of a hydraulic work. The hydraulic work can comprise, for example, a canal, a dam, a water basin, a hydraulic tunnel, and more.

Geomembrane sheets 1*a*, 1 *b* are blocked and made adhere to the surface 2 of a hydraulic work, whose body is indicated by 3. The waterproofing liner 1 is sealingly clamped and tensioned by means of a plurality of locking assemblies 4 configured for sealingly locking and tensioning the geomembrane sheets. The various locking assemblies 4 extend (for example in a canal or hydraulic tunnel) in a longitudinal direction and are intended to be positioned on the surface 2 along respective surface portions extended longitudinally (anchor strips) being parallel and at a certain distance from each other.

Each locking assembly 4 comprises a lower metal section bar 5 and an upper metal section bar 6, for example in stainless steel.

The lower section bar 5 is configured with a raised part having trapezoidal shape, comprising an upper wall 5*a* (for example flat) and two side opposite walls 5*b* (for example flat and inclined with respect to the upper wall 5*a*). Lower section bar 5 also comprises, in the example of FIGS. 1-5, two side wings 5*c* for the anchoring to the body 3 of the hydraulic work.

The upper section bar 6 conforms to the trapezoidal shape of the raised part of the lower section bar 5. In particular the upper section bar 6 comprises an upper part 6*a* (for example flat) and two sides opposite walls 6*b* (for example flat and inclined with respect to the upper wall 6*a*).

The side walls 6*b* can be more inclined than side walls 5*b*, in order to guarantee a compression action of the geomembrane between these side walls and thus improve the sealingly clamping.

By reference number 7 it is indicated a gasket (for example made of ethylene propylene diene monomer rubber, hereinafter referred to as "EPDM") arranged between the overlapped edges of the two sheets of geomembrane 1*a*, 1*b* and the upper wall 5*a* or 6*a* of lower section bars 5 and upper section bars 6. In the case shown in FIG. 1, the gasket 7 is arranged between the upper wall 6*a* of the upper section bar 6 and the edges of the geomembrane sheets 1*a*, 1*b*.

Lower and upper section bars 5 and 6 are connected among them through a set of connecting members 8, for example of screw type. Gasket 7 is used for the sealing near the connecting members 8. Assembly 4 can comprise more additional gaskets, one for each connecting member 8, or a single elongated gasket 7 applying to all connecting members 8.

Each connecting member 8, in these examples, is disengageably connected to a corresponding internally threaded bush 9 being fixed (for example by snap-fit coupling or welding) underneath the upper wall 5*a* of the lower section bar 5.

The lower section bar 5 is anchored to the hydraulic work through a plurality of anchoring devices 10 (for example of the prior art type) that deeply penetrate within the body of the hydraulic work, through anchoring holes 11 in correspondence of a plurality of anchoring zones 21.

By reference number 11 it is indicated the anchoring holes on the side wings 5*c* (in the example of FIGS. 1-5) for the passing through of anchoring devices 10; by reference numbers 12*a* and 12*b* the connecting holes on the upper walls 5*a* and 6*a* for the passing through of the connecting members 8; and by reference numbers 13 and 14 the opposed inclined flat surfaces, respectively of side walls 5*b* and 6*b*, between which the waterproofing liner 1 is compressed and clamped.

The anchoring holes 11 are distributed in such a way as to form various sets of anchoring holes in respect to the various anchoring zones 21 axially spaced apart in the longitudinal direction of the locking assembly 4. Each set of holes is formed by two or more anchoring holes 11 (by three holes 11 in the examples of FIGS. 1-5 and FIGS. 6-8, by two holes 11 in the example of FIGS. 9-11). The space between the anchoring holes 11 belonging to a same set of holes is relatively small, in particular is less than a pitch P (for example constant) between two sets of the anchoring holes 11. The space between the anchoring holes 11 belonging to a same set of holes is less than the axial space (in a longitudinal direction) between two anchoring holes 11 belonging to two different sets of holes, that is two different anchoring zones 21. The connecting holes 12*a* and 12*b* are spaced apart in the longitudinal direction by a pitch S (constant or not) that is less than the pitch P (constant or not) between two sets of anchoring holes 11. In this way it is possible to have a relatively high number of connecting holes 12*a*, 12*b*, in order to guarantee an effective and strong locking of the upper section bar 6 to the lower section bar 5 of each assembly 4, avoiding distortions of the upper section bar 6 caused by the stresses or external forces acting on the waterproofing liner.

In the examples here illustrated, connecting the holes 12*a* and 12*b* are spaced apart at a constant pitch S, while the sets of anchoring holes 11 are basically equal one another and are arranged in such a way that corresponding anchoring holes 11 having the same position in two sets of adjacent holes, are spaced apart at a constant pitch P. Pitch P of anchoring holes 11 is greater (for example greater of 30%, or greater of 40%, or greater of 50%) than pitch S of connecting holes 12.

The thickness of the upper section bar 6 is greater than the thickness of lower section bar 5. In particular the thickness of the upper section bar 6 is greater of at least 20% than the thickness of the lower section bar 5. In this case, the upper section bar 6 has an average thickness (constant) of 4-5 mm while lower section bar 5 has an average thickness (constant) of 2.5-3.5 mm. In this way the solidity of a locking assembly 4 is further improved as well as its resistance to stresses transmitted by waterproofing liner 1.

Finally by reference number 22 it is indicated an additional waterproof strip for sealing and protection (optional), put on the top of the upper section bar 6*a*; the waterproofing strip 22 consists, for example of a geomembrane strip welded on both sides to the geomembrane of liner 1; strip 22 extends all along the section bar 6*a*; strip 22, besides being water resistant, can be necessary in case of ice formation and in case the presence of section bars 5, 6 in stainless steel has to be hidden, in order to avoid thefts or vandalism.

Figure 6:
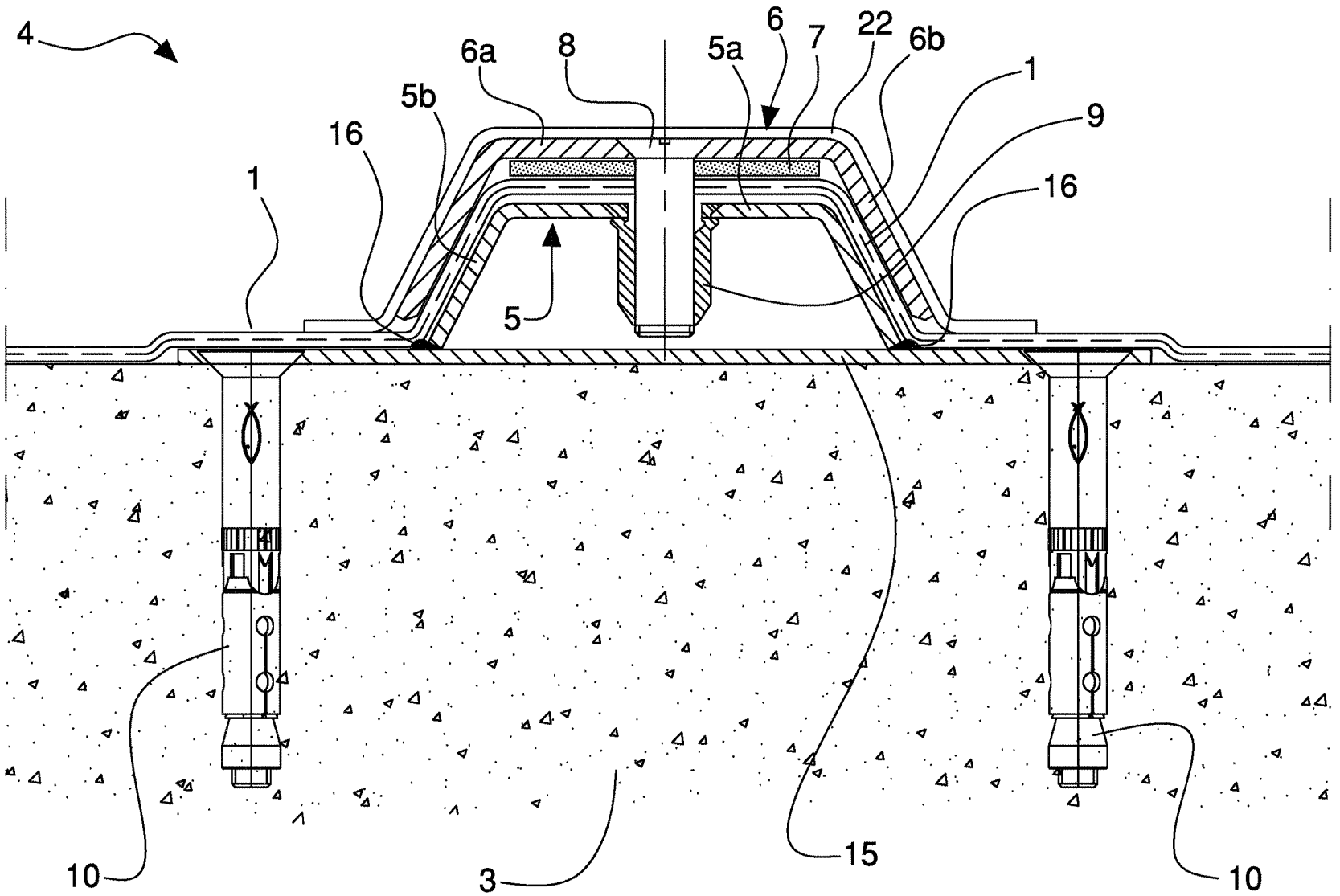
FIG. 6 is a cross-section of a second example of a locking assembly according to the present invention, wherein the lower section bar is welded to an additional elongated anchoring element.
Figure 7:
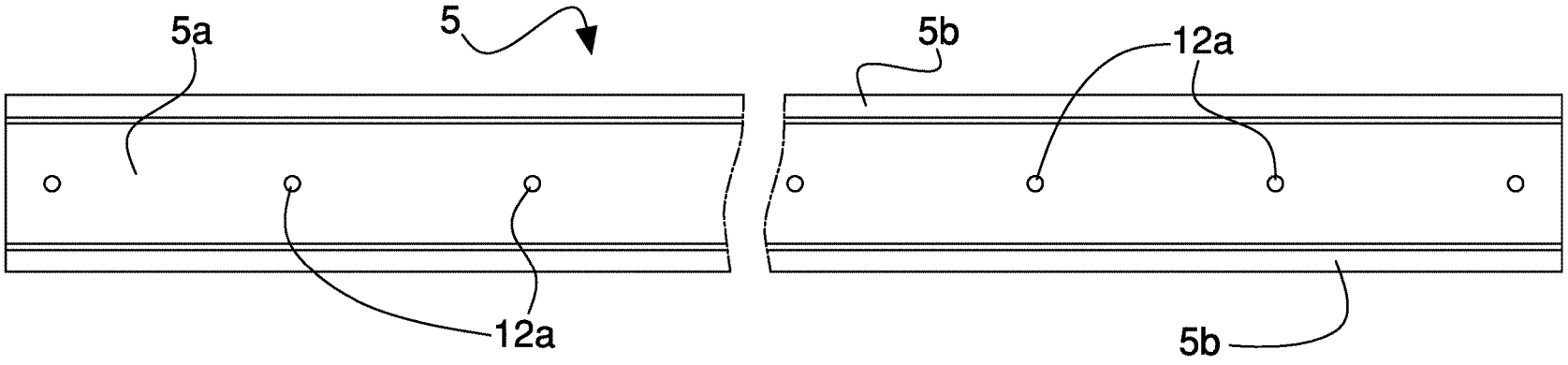
FIG. 7 is a view from above, of the sole lower section bar of the locking assembly of FIG. 6, without the additional elongated anchoring element.
Figure 8:
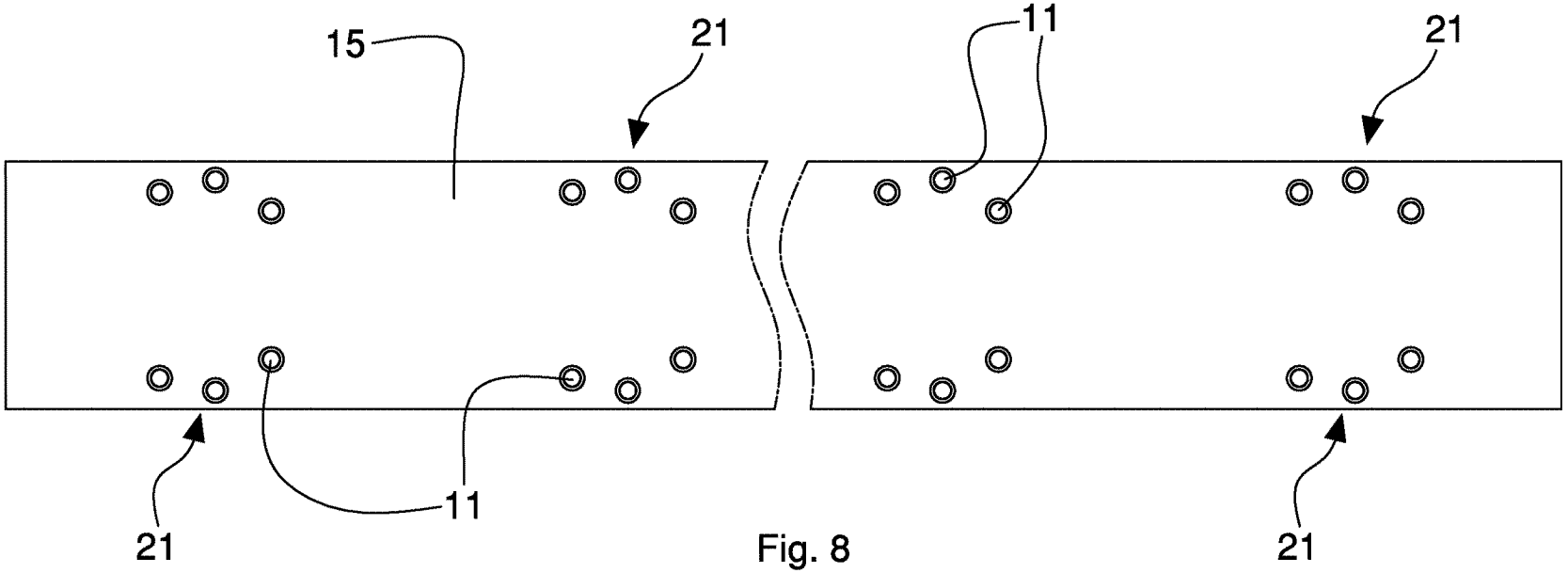
FIG. 8 is a view from above, of the additional elongated anchoring element of the locking assembly of FIG. 6.

The second example, shown in FIGS. 6-8, differs from the first one basically because in this case the locking assembly 4 comprises a flat additional elongated anchoring element 15 presenting anchoring holes 11 in a plurality of anchoring zones 21, as in the previous case. Therefore the additional elongated anchoring element 15 is clamped to the body 3 of the hydraulic work by means of anchoring devices 10, while the lower section bar 5, being in this case without anchor lateral wings 5*c* of the previous example, is connected to the additional elongated anchoring element 15, for example by welding lines 16, as in this example or through a specific welding.

Figure 9:
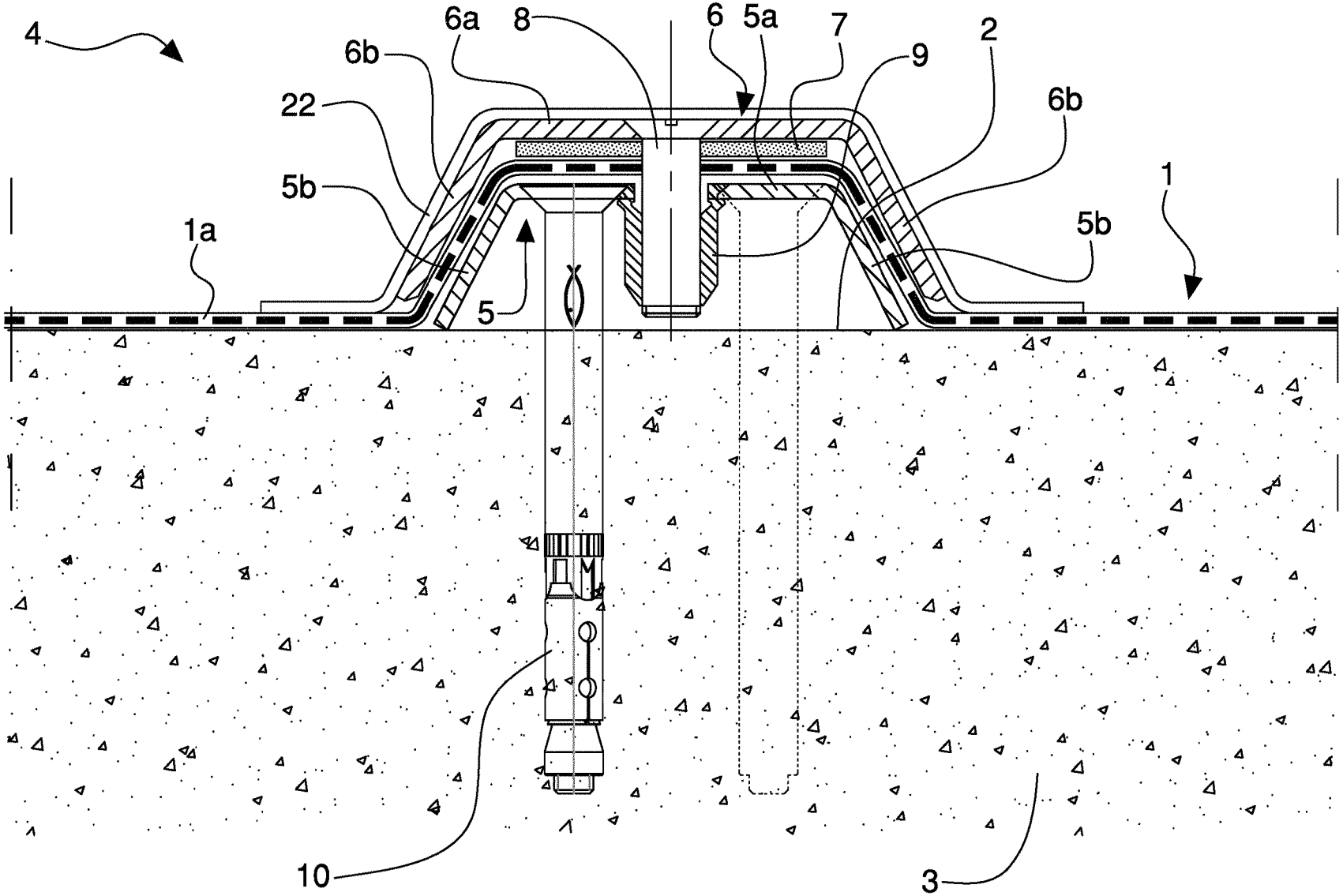
FIG. 9 is a cross-sectioned view of a third example of a locking assembly according to the present invention.
Figure 10:
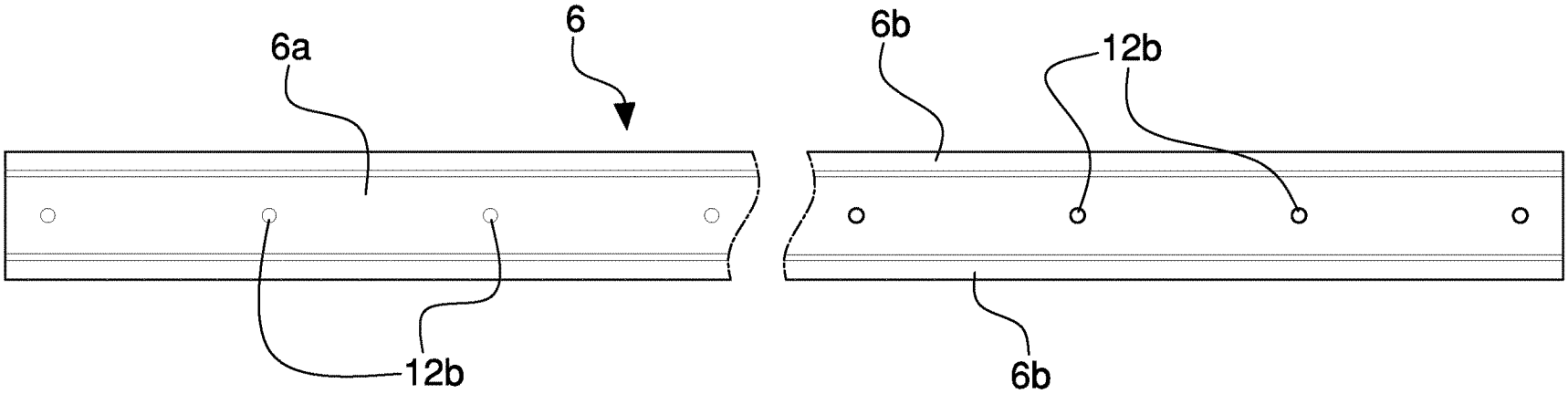
FIG. 10 is a view from above, of the upper section bar of the locking assembly of FIG. 9.
Figure 11:
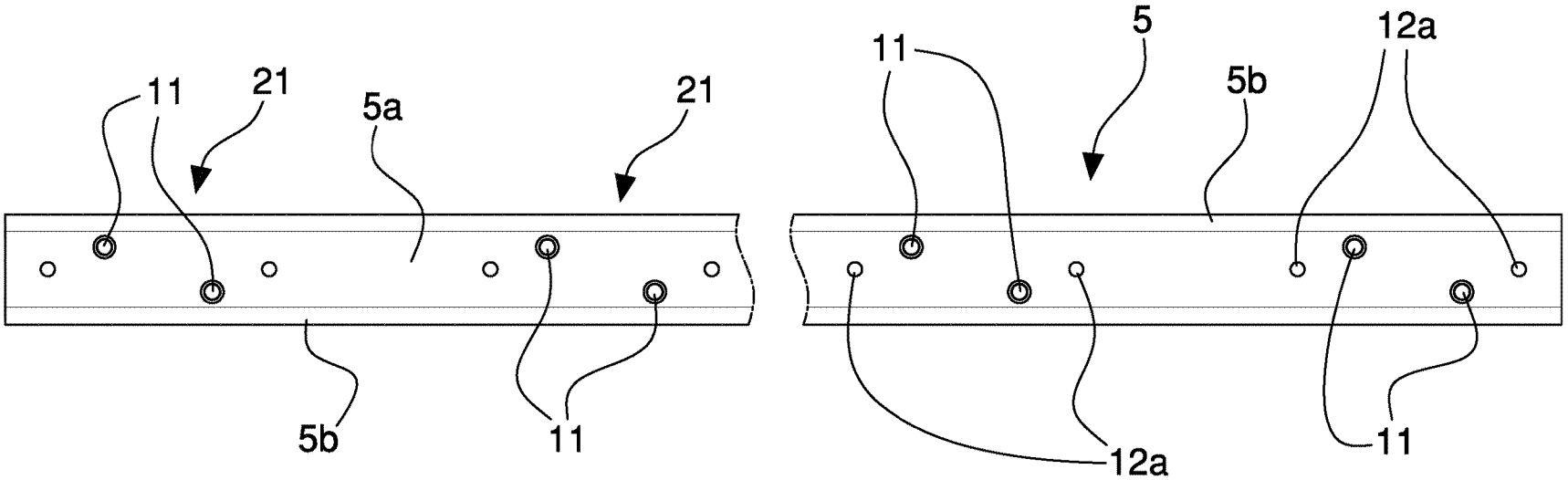
FIG. 11 is a view from above, of the lower section bar of the locking assembly of FIG. 9.

The third example, shown in FIGS. 9-11, differs from the preceding examples because the holes 11 of the single anchoring zones 21, are arranged (in groups of two) on the raised part, in particular on the upper wall 5*a* of the lower section bar 5. In this case the anchoring devices 10 pass through the upper wall 5*a*.

According to the method of the present invention, on the surface 2 of the hydraulic work to be made waterproof, a plurality of anchor strips B will be located, being extended in a longitudinal direction (for example horizontal in case of canals and hydraulic tunnels, in particular vertical in case of dams), parallel and spaced apart among them; each locking assembly 4 will be arranged on a corresponding anchor strip of the surface 2; each locking assembly 4 will be provided with a plurality of anchoring zones 21, each one corresponding to a set of anchoring holes 11 (two or more); for each anchor strip B (associated to a corresponding locking assembly 4) a plurality of anchoring zones will be identified (indicated by reference 20 in FIGS. 12-15): each anchoring zone 20 will be associated a relative anchoring zone 21 on the locking assemblies 4, in other words a corresponding set of anchoring holes 11 formed by two or more holes for anchoring the lower section bars 5 to the body 3 of the hydraulic work.

Now, particularly referring to FIGS. 12-15 that show a part of an anchor strip B on which a corresponding locking assembly 4 will be arranged, a specific example will be illustrated of a method for laying down the waterproofing liner 1 on the surface 2 of the hydraulic work.

In a first phase (FIGS. 12 and 13) the surface 2 of the hydraulic work is marked by a series of reference marks 19 for each anchor strip B, in correspondence of a plurality of anchoring zones 20 distributed along each anchor strip B, according to axially spaced apart positions in the longitudinal direction of each locking assembly, in the same positions of anchoring holes 11 of lower section bar 5.

Figure 12:
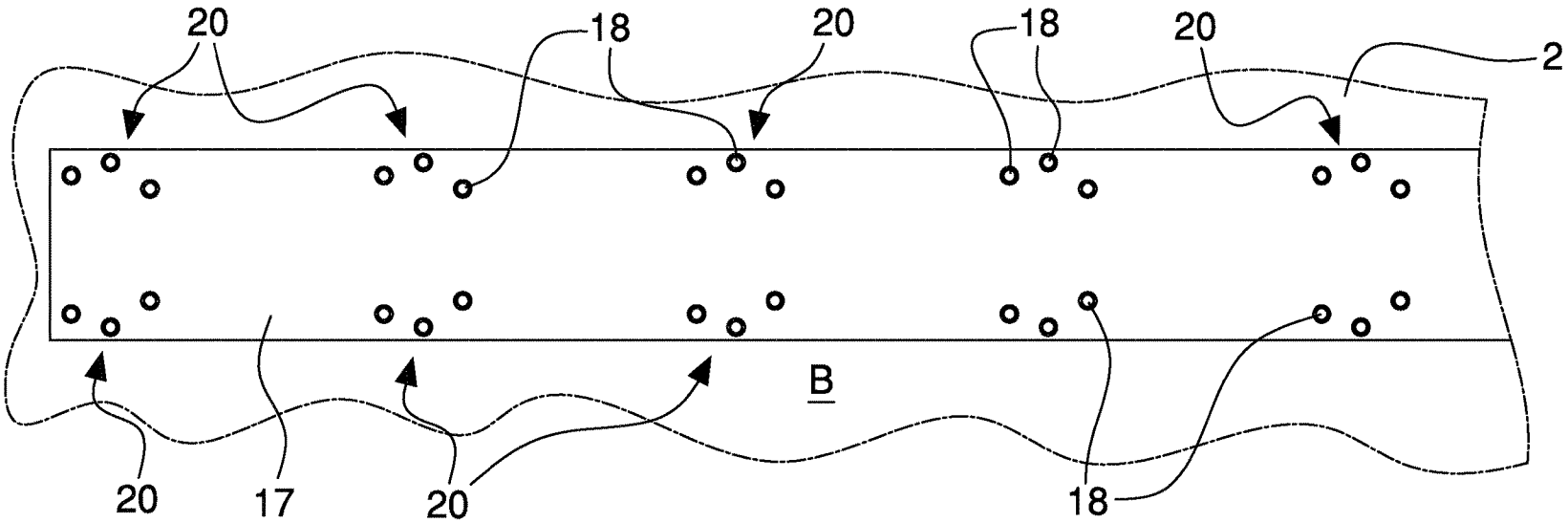
Figure 13:
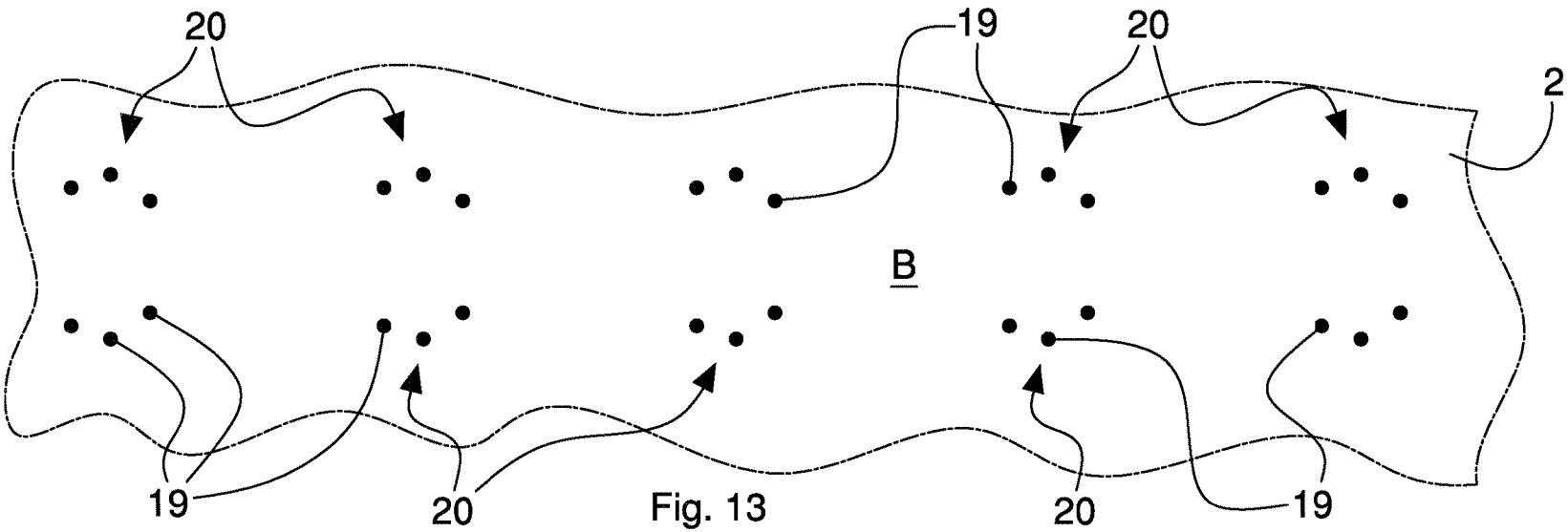
Figure 14:
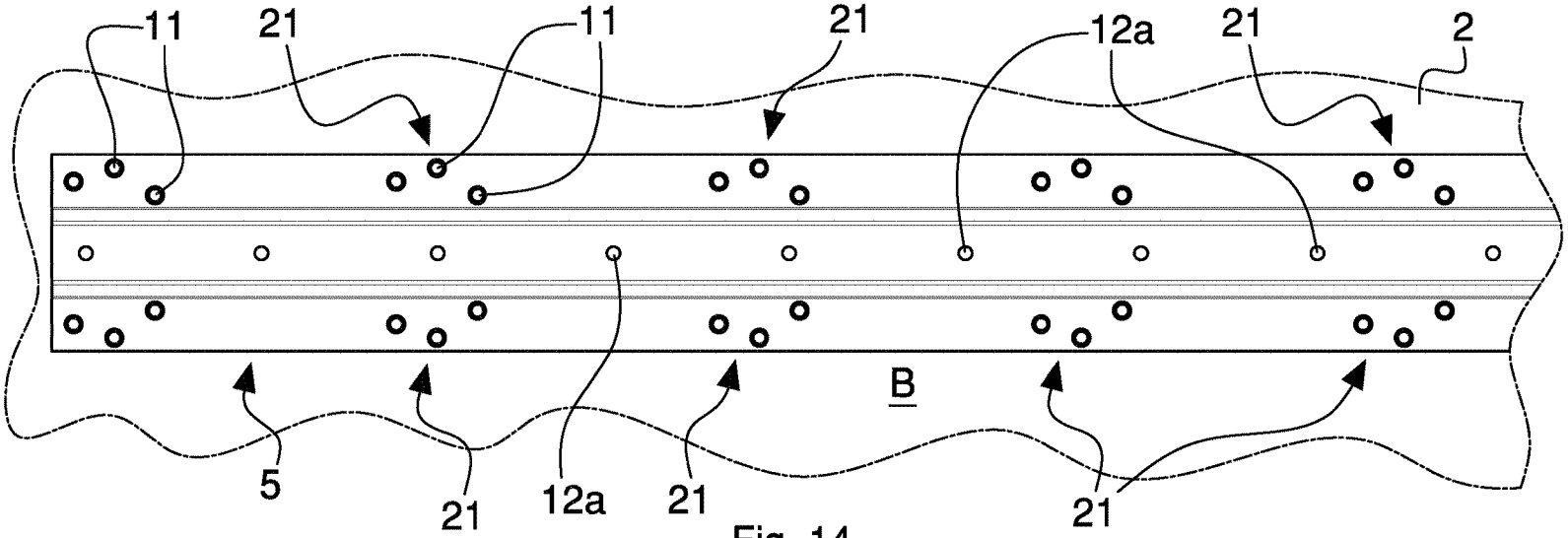
Figure 15:
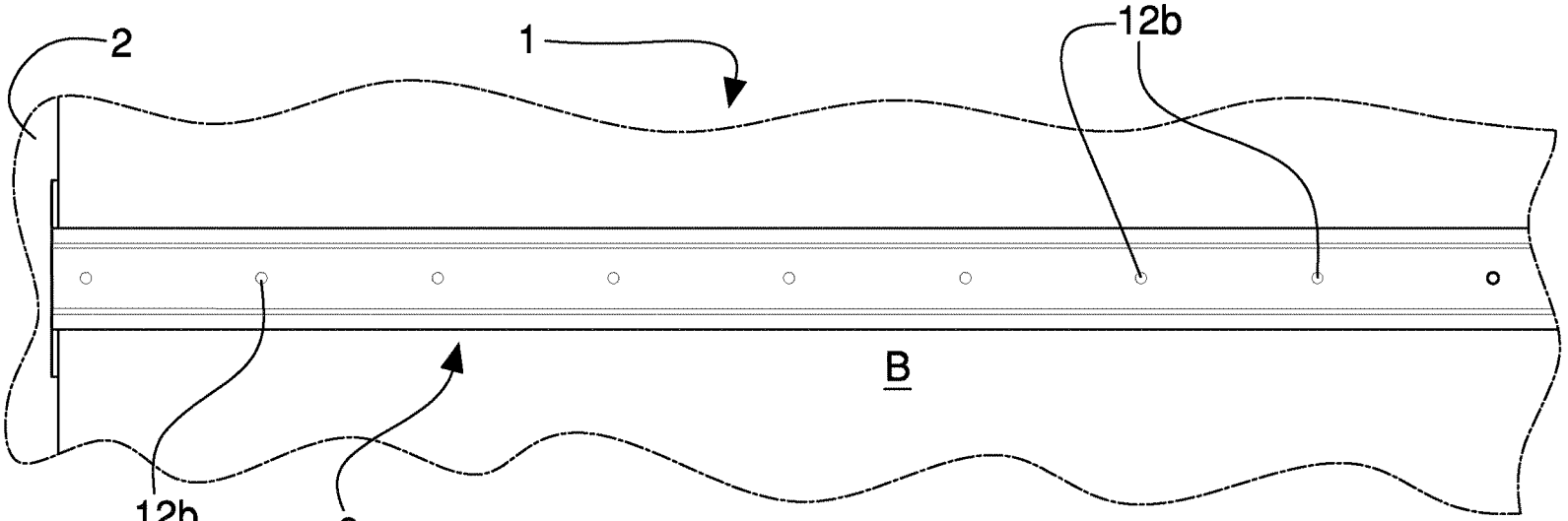

Such marking can be implemented in any way, for example making use of a mask 17 (for example in the form of a plate arranged lengthwise) that, as for lower section bars 5, presents a number of reference holes 18 to create (for example by spraying a paint) reference marks 19 on the surface 2 in the various anchoring zones 20. FIG. 12 shows the mask 17 positioned on the anchor strip B of the surface 2, while FIG. 13 shows the anchor strip after the marking with the reference marks 19 and after the removal of the mask 17.

Reference marks 19 are positioned in a way as to correspond to the positions of the anchoring holes 11 used to configure the lower section bar 5, or the lower additional elongated anchoring element 15.

In a second phase (FIG. 14) each lower section bar 5 (or additional elongated anchoring element 15) is positioned on each anchor strip of the surface 2 of the hydraulic work, aligning the anchoring holes 11 of each anchoring zone 21 on the lower section bar 5 or additional elongated anchoring element 15, to the reference marks 19 of each anchoring zone 20 of the surface 2.

The lower section bar 5 (or additional elongated anchoring element 15) is therefore anchored to the hydraulic work, using the anchoring holes 11 aligned to reference marks 19 in which position there is no obstacle to the insertion of anchoring devices 10.

In practise, it is possible to proceed perforating the body 3 of the hydraulic work in correspondence of a reference mark 19 in a first anchoring zone 20; if no obstacle is found during the perforation, once perforation is made, it is possible to proceed with a reference mark 19 of another anchoring zone 20; on the contrary, if an obstacle is found, the perforation of the body 3 of the hydraulic work will be made beside another reference mark 19 of the same anchoring zone 20; in this way it will be possible to use, for each anchoring zone 20, at least an anchoring hole 11 next to which there is no obstacle to the insertion of the anchoring device 10, being unlikely that, for each anchoring zone 20, there is not at least a marked position without obstacles.

Once holes in the various anchoring zones 20 along each anchor strip B have been made, it is possible to fasten the various lower section bars 5 (or additional elongated anchoring elements 15) to the body 3 of the hydraulic work, by matching holes 11 of the anchoring zones 21 of each lower section bar 5 or additional elongated anchoring element 15, to the holes made at the reference marks 19 of the anchoring zones 20 of each anchor strip.

After that, once fastened the various lower section bars 5 to the body 3 of the hydraulic work, in a third phase (FIG. 15), the waterproofing liner is laid down, anchored and tensioned connecting each upper profile 6 to the correspondent lower section bar 5, by sealingly clamping the waterproofing liner between the flat inclined surfaces 13 and 14 that are opposed of the lower section bar 5 and of the upper section bar 6.

The locking assembly 4 can comprise, in particular, a drainage device to make flow the water accumulated between the waterproofing liner 1 and the surface 2 of the hydraulic work. Such drainage device can however be configured; for example they can comprise an element suitable for creating a gap between the wings 5*c* of the lower section bar 5 and the surface 2 of the hydraulic work, with the wings of the section bar 5 being slightly raised with respect to the surface 2, in order to allow the passage of accumulated water. Such distance of the lower section bar 5 from the surface 2, can be implemented in various ways: for example it is possible to arrange a spacer (for example a lock washer), in particular in correspondence of one or more anchoring holes 11; it is also possible, for example, that the section bar is provided with at least one or more protrusions (for example an evident embossed of the iron sheet), in particular at least one or more anchoring holes 11; it is also possible, for example, to implement pass through openings (small holes) through the lower section bar 5 (in particular through the base of the walls 5*a* and 5*b*); it is also possible, for example, to fold the side wings 5*c* and obtain pass through openings (small holes) as in the previous example.

The invention claimed is:

1. A method for laying down and tensioning a waterproofing liner on a surface of a hydraulic work, wherein the waterproofing liner is fastened, tensioned and made to sealingly adhere to the surface of the hydraulic work by sealingly clamping the waterproofing liner by a plurality of locking assemblies, wherein each locking assembly includes a lower metal section bar anchored to the surface of the hydraulic work, and an upper metal section bar that conforms to the lower section bar; and wherein the waterproofing liner is sealingly clamped between the lower section bar and the upper section bar; wherein said method includes the steps of:

a) configuring the lower section bar with a plurality of first anchoring zones, arranged in axially spaced apart positions in a longitudinal direction of the respective locking assembly, each first anchoring zone having a set of anchoring holes, and configuring the lower section bar with a different set of connecting holes, arranged in axially spaced apart positions, wherein the arrangement of the connecting holes is parallel with the arrangement of the first anchoring zones, wherein a pitch between the connecting holes is different from a pitch between the first anchoring zones;

b) marking second anchoring zones on the surface of the hydraulic work with a set of reference marks in positions corresponding to the positions of the anchoring holes of the first anchoring zones;

c) perforating the surface of the hydraulic work at at least one reference mark of each second anchoring zone;

d) positioning the lower section bar, aligning the set of anchoring holes of each first anchoring zone of the lower section bar with the perforations made at each second anchoring zone of the surface of the hydraulic work;

e) anchoring the lower section bar to the hydraulic work, by passing anchoring devices through said anchoring holes that are aligned to perforations made at the reference marks which are found to have no obstacle during the step of perforating; and f) laying down, anchoring and tensioning the waterproofing liner, connecting the upper section bar to the lower section bar of each locking assembly by connecting members passing through the set of connecting holes, and sealingly clamping the waterproofing liner between opposite sloping flat walls of the lower section bar and the upper section bar.

2. The method of claim 1, wherein a pitch between the anchoring holes within each first anchoring zone is less than the pitch between the first anchoring zones.

3. The method of claim 2, wherein the connecting members are disengageable, and wherein the upper section bar is connected to the lower section bar by inserting the connecting members through connecting holes on said upper section bar and the connecting holes of said lower section bar, wherein a pitch between the connecting holes of the upper section bar and the pitch between the connecting holes of the lower section bar are less than the pitch between the first anchoring zones.

4. The method according to claim 1, wherein, at the presence of an obstacle detected at a time of perforating a body of the hydraulic work at one reference mark of one second anchoring zone, another perforation is made at another reference mark of the same second anchoring zone.

5. The method according to claim 1, wherein the lower section bar is connected to a lower elongated anchoring element after the latter has been positioned and anchored to the surface of the hydraulic work.

6. The method according to claim 1, wherein the surface of the hydraulic work is marked with the reference marks making use of an auxiliary mask provided with reference holes arranged in positions corresponding to the positions of the anchoring holes of the lower section bar.

7. The method according to claim 1, wherein the lower section bar has side wings configured with the set of anchoring holes at each first anchoring zone.

8. The method according to claim 1, wherein said locking assembly comprises the lower section bar and an elongated anchoring element underneath the lower section bar; and said elongated anchoring element is configured with the set of anchoring holes at each first anchoring zone.

9. A locking assembly suitable for laying down and tensioning a waterproofing liner on a surface of a hydraulic work, wherein said locking assembly includes:

a lower metal section bar configured to be anchored to the surface of the hydraulic work; and an upper metal section bar that conforms to the lower section bar;

wherein an elastically yieldable waterproofing liner is meant to be locked and tensioned by sealingly clamping the waterproofing liner between the lower section bar and the upper section bar;

said lower section bar having a plurality of anchoring zones arranged in axially spaced apart positions in a longitudinal direction of the locking assembly, wherein each anchoring zone is configured with a set of anchoring holes to introduce anchoring devices into a body of the hydraulic work, and said lower section bar having a different set of connecting holes arranged in axially spaced apart positions, said connecting holes being configured to receive connecting members for attaching the upper section bar to the lower section bar, wherein the arrangement of the connecting holes is parallel with the arrangement of the anchoring zones; and wherein said anchoring zones are spaced apart by a pitch in the longitudinal direction of the locking assembly, wherein a pitch between the connecting holes is different from the pitch between the anchoring zones;

wherein said lower section bar is configured to be anchored to the surface of the hydraulic work by passing the anchoring devices through said anchoring holes that are aligned to perforations made at reference marks on the surface which are found to have no obstacle during a perforation process.

10. The locking assembly of claim 9, wherein a pitch between the anchoring holes belonging to a first anchoring zone of the anchoring zones is less than the pitch between the first anchoring zone and a second adjacent anchoring zone of the anchoring zones.

11. The locking assembly of claim 9, wherein the upper section bar is connected to the lower section bar by the connecting members inserted through connecting holes of said upper section bar and the connecting holes of said lower section bar, wherein the respective connecting holes of said upper and lower section bars are spaced apart in the longitudinal direction by a pitch that is less than the pitch between a first anchoring zone and a second adjacent anchoring zone.

12. The locking assembly according to claim 9, wherein the lower section bar comprises a raised central part and lateral wings provided with the sets of anchoring holes, and wherein said raised central part of the lower section bar includes the connecting holes for connection to the upper section bar.

13. The locking assembly according to claim 9, wherein a raised part of the lower section bar includes the plurality of anchoring zones configured with the anchoring holes for anchoring to the hydraulic work.

14. The locking assembly according to claim 9, including a drainage device for discharging water accumulated between the waterproofing liner and the surface of the hydraulic work.

15. The locking assembly according to claim 9, wherein the lower section bar has side wings configured with the set of anchoring holes at each anchoring zone.

16. The locking assembly according to claim 9, comprising an elongated anchoring element underneath the lower section bar; and said elongated anchoring element is configured with the set of anchoring holes at each anchoring zone.

17. The locking assembly according to claim 16, wherein the elongated anchoring element is mechanically connected to the lower section bar.

18. A device for laying down and tensioning a waterproofing liner on a surface of a hydraulic work, wherein said device includes a plurality of locking assemblies that extend in a longitudinal direction for sealingly clamping and tensioning the waterproofing liner, each locking assembly includes:

a lower metal section bar configured to be anchored to the surface of the hydraulic work; and an upper metal section bar that conforms to the lower section bar;

wherein an elastically yieldable waterproofing liner is meant to be locked and tensioned by sealingly clamping the waterproofing liner between the lower section bar and the upper section bar;

said lower section bar having a plurality of anchoring zones arranged in axially spaced apart positions in the longitudinal direction of the locking assembly, wherein each anchoring zone is configured with a set of anchoring holes to introduce anchoring devices into a body of the hydraulic work, and said lower section bar having a different set of connecting holes arranged in axially spaced apart positions, said connecting holes being configured to receive connecting members for attaching the upper section bar to the lower section bar, wherein the arrangement of the connecting holes is parallel with the arrangement of the anchoring zones; and wherein said anchoring zones are spaced apart by a pitch in the longitudinal direction of the locking assembly, wherein a pitch between the connecting holes is different from the pitch between the anchoring zones;

wherein said lower section bar is configured to be anchored to the surface of the hydraulic work by passing the anchoring devices through a group of said anchoring holes that are aligned to perforations made at reference marks on the surface which are found to have no obstacle during a perforation procedure.

19. The device of claim 18, including at least one auxiliary mask provided with reference holes to mark the surface of the hydraulic work with a set of reference marks, in positions corresponding to positions of the anchoring holes on the lower section bar.

20. The device according to claim 18, wherein the lower section bar has side wings configured with the set of anchoring holes at each anchoring zone.

21. The device according to claim 18, wherein each locking assembly comprises an elongated anchoring element underneath the respective lower section bar; and each said elongated anchoring element is configured with the set of anchoring holes at each anchoring zone.

22. A waterproofing liner assembly for a surface of a hydraulic work, wherein said waterproofing liner assembly includes a plurality of impermeable geomembrane sheets, and a plurality of devices fastened and made to adhere to the surface of the hydraulic work by: a plurality of locking assemblies that extend in a longitudinal direction for sealingly clamping and tensioning the geomembrane sheets, each locking assembly includes:

a lower metal section bar configured to be anchored to the surface of the hydraulic work; and an upper metal section bar that conforms to the lower section bar;

wherein an elastically yieldable waterproofing liner is meant to be locked and tensioned by sealingly clamping the waterproofing liner between the lower section bar and the upper section bar;

said lower section bar having a plurality of anchoring zones arranged in axially spaced apart positions in a the longitudinal direction of the locking assembly, wherein each anchoring zone is configured with a set of anchoring holes to introduce anchoring devices into a body of the hydraulic work, and said lower section bar having a different set of connecting holes arranged in axially spaced apart positions, said connecting holes being configured to receive connecting members for attaching the upper section bar to the lower section bar, wherein the arrangement of the connecting holes is parallel with the arrangement of the anchoring zones; and wherein said anchoring zones are spaced apart by a pitch in the longitudinal direction of the locking assembly, wherein a pitch between the connecting holes is different from the pitch between the anchoring zones;

wherein said lower section bar is configured to be anchored to the surface of the hydraulic work by passing the anchoring devices through a group of said anchoring holes that are aligned to perforations made at reference marks on the surface which are found to have no obstacle during a perforation procedure.

23. The waterproof liner assembly according to claim 22, wherein the lower section bar has side wings configured with the set of anchoring holes at each anchoring zone.

24. The waterproof liner assembly according to claim 22, wherein each locking assembly comprises an elongated anchoring element underneath the respective lower section bar; and each elongated anchoring element is configured with the set of anchoring holes at each anchoring zone.

* * * * *